US005540893A

United States Patent [19]

English

[11] Patent Number: 5,540,893

[45] Date of Patent: Jul. 30, 1996

[54] UPPER FEED INJECTOR FOR FLUIDIZED CATALYTIC CRACKING UNIT

[75] Inventor: Alan R. English, Richmond, Calif.

[73] Assignee: Chevron U.S.A. Inc., San Francisco, Calif.

[21] Appl. No.: 702,435

[22] Filed: May 16, 1991

Related U.S. Application Data

[63] Continuation of Ser. No. 328,061, Mar. 23, 1989, abandoned.

[51] Int. Cl.[6] ..... F27B 15/08

[52] U.S. Cl. ..... 422/144; 422/140; 422/147

[58] Field of Search ..... 208/113, 159, 208/164; 422/140–144, 146–147, 214; 431/7, 170

[56] References Cited

U.S. PATENT DOCUMENTS 3,152,065 10/1964 Sharp et al. ..... 422/140

3,607,730 9/1971 Pfeiffer ..... 422/141

4,284,401 8/1981 Tatebayashi et al. ..... 422/143

4,725,410 2/1988 Krug et al. ..... 422/144

*Primary Examiner*—Robert J. Warden

*Assistant Examiner*—Hien Tran

*Attorney, Agent, or Firm*—A. H. Uzzell; L. S. Squires

[57] ABSTRACT

A hydrocarbon feed pipe in a fluid catalytic cracking system includes a nozzle positioned in the upper section of the riser reactor pipe. This arrangement, together with one or more feed pipes at conventional locations in the riser reactor pipe, allows for feed segregation or feed splitting processes whereby different feed flow rates and/or compositions are fed to different points in the riser reactor pipe. Feed splitting/segregating processes provide for improved product yields and product properties.

11 Claims, 2 Drawing Sheets

UPPER FEED INJECTOR FOR FLUIDIZED CATALYTIC CRACKING UNIT

This application is a continuation of application Ser. No. 328,061, filed Mar. 23, 1989, now abandoned.

BACKGROUND OF THE INVENTION

1. Field of the Invention

This invention relates to a method and apparatus for fluidized catalytic cracking. More particularly, it relates to improvements in the feeding of hydrocarbonaceous materials to a cracking apparatus by split injection, whereby at least a portion of the feed is injected into a downstream section of a riser reactor pipe, the downstream section being contained within a separation chamber. The split feeding enhances gasoline octanes and product yields.

2. Description of the Prior Art

Fluidized cracking of heavy petroleum fractions is one of the major refining methods used to convert crude petroleum oil to useful products, such as fuels for internal combustion engines. In such fluidized catalytic cracking (known popularly as "FCC"), high molecular weight hydrocarbon liquids and vapors are contacted with hot, finely divided solid catalyst particles in an elongated riser or transfer line reactor. The riser reactor is usually in the form of a riser pipe and the contacting time is on the order of a few seconds, say from 1 to 10 seconds, and generally not over about 5 seconds. During this short period, catalysts at temperatures in the range of from about 1100° F. to 1400° F. are contacted with a hydrocarbon feedstock, frequently in the form of vacuum gas oil, cycle oil or the like, heated to a temperature of from about 300° to 800° F.

The reaction is one of rapid generation of large volumes of gaseous hydrocarbons. The hydrocarbons and catalyst mixture flow out of the riser reactor into a separator vessel wherein the resultant gaseous hydrocarbons are taken off for distillation into various product fractions defined by boiling ranges. The spent catalyst is separated in the separator vessel as rapidly as possible and stripped of residual hydrocarbons by passage through a stripper section. The catalyst is then returned to a regenerator where residual hydrocarbons on the spent catalyst, called "coke," are burned off by passing a stream of an oxygen-containing gas, such as air, or oxygen enriched air, through them. The heat generated in this regeneration step is used as the heat source which heats the catalyst and thus provides the elevated temperatures needed for reaction with the incoming hydrocarbon feed. Regenerated hot catalyst is then recycled by gravity primarily for further reaction with feed in the riser reactor.

There are generally two arrangements for conveying reacted hydrocarbons and spent catalyst from the riser reactor to the separator vessel. The first is through an "external" riser reactor in which the end section of the riser reactor passes through the wall of the separator vessel. Substantially all of the reaction in the riser reactor takes place prior to the mixture reaching the separator vessel. The end section enters through the sidewall in the upper portion of the vessel where the majority of separation occurs.

The other arrangement is for a portion of the riser reactor, including the end section, to be located within the separator vessel, i.e., an "internal" riser. The riser reactor enters the separator vessel at the lower portion thereof and extends substantially vertically into the upper portion. A substantial amount of the reaction takes place in the internal section located within the separator vessel.

SUMMARY OF THE INVENTION

With an internal riser, a problem occurs when a split feed system is desired. Split feeding provides for the introduction of hydrocarbon feed (having either same or different composition) into the riser reactor at multiple locations and results in various benefits to the process such as improved unit yields and product quality. Gasoline octanes and alkylate yields may also be increased. When feed injection is desired or needed at a point in the internal riser located within the separator vessel, however, there has heretofore been no suitable, economical arrangement for providing this feature.

Theoretically a feed line entering through the upper portion of the separator vessel, in the same manner as an external riser reactor, could provide this function. Such an arrangement, however, would entail great expense, especially in the case of retrofitting existing FCC apparatus having an internal riser reactor. Moreover, the introduction of feed through the sidewall of the separator vessel would require a number of seals to prevent escape of hydrocarbon feed and catalyst which would increase the possibility of leakage.

According to this invention a split feed design in an FCC unit is provided which permits use of split feeding in an internal riser reactor without undue expense. According to this invention there is provided a split feed design which can be easily retrofitted to existing FCC units containing internal riser reactors.

As particularly distinguished from the prior art, the present invention is directed to a fluidized catalytic cracking system having an internal riser in which improved yields and product quality are obtained by introducing a portion of the hydrocarbon feed into one or more locations of the portion of the internal riser reactor enclosed by the separator vessel. One or more hydrocarbon feed pipes to the enclosed section enter the riser reactor upstream of the enclosed section and extend downstream to within the enclosed section. The feed pipes end short of a discharge orifice of the riser reactor, so that feed exiting the feed pipes is mixed with catalyst prior to exiting the riser reactor through the discharge orifice.

Further objects and advantages of the present invention will become apparent from the following detailed description of the preferred embodiments of the invention which are illustrated and described in connection with the accompanying drawings. The drawings form an integral part of the present specification and illustrate the operating advantages and principles of the present invention.

In one embodiment, the objects of the invention are achieved by an apparatus for fluidized catalytic cracking of hydrocarbons which includes a riser reactor means for circulating a heated mixture of catalyst particles and hydrocarbonaceous material for catalytic reaction of the material in the riser reactor, means for downstream discharging of the output of the riser reactor downwardly into a large diameter separator vessel, the riser reactor including an internal portion disposed within the separator vessel and extending from a lower portion of the vessel to an upper portion thereof and an external portion not enclosed by the separator vessel, means for separating hydrocarbon vapors from spent catalyst in the separator vessel, stripping means for recovering residual hydrocarbon vapors from the spent catalyst passing from the separator vessel to a catalyst regenerator for recycling of regenerated catalyst to the reactor pipe and means within the separator vessel for recovering cracked hydrocarbon vapors for transfer to hydrocarbon recovery means for recovery of hydrocarbon components therein, whereby at least one hydrocarbon feed means is positioned within the internal portion of the riser reactor. A feed line enters the riser reactor at the external portion and extends in the riser reactor to a downstream location in the internal portion. A nozzle means is connected to the feed line at the downstream location for injecting the hydrocarbon feed into the riser reactor.

In a second embodiment, the apparatus includes at least two hydrocarbon feed means, in which a first feed means injects hydrocarbon feed into the internal portion of the riser reactor and a second feed means injects hydrocarbon feed into the external portion of the riser reactor. The composition of the feed may be the same or different for each feed means.

In a third embodiment, the invention is a method for retrofitting a fluidized catalytic cracking apparatus having an internal riser reactor which includes providing at least one hydrocarbon feed means in the internal portion of the riser reactor, the feed means including a feed line entering the riser reactor at the external portion and extending in the riser reactor to a downstream location in the internal portion and a nozzle means connected to the feed line at a downstream location for injecting the hydrocarbon feed in the riser reactor.

IN THE DRAWINGS

DESCRIPTION OF THE PREFERRED EMBODIMENTS OF THE INVENTION

Figure 1:
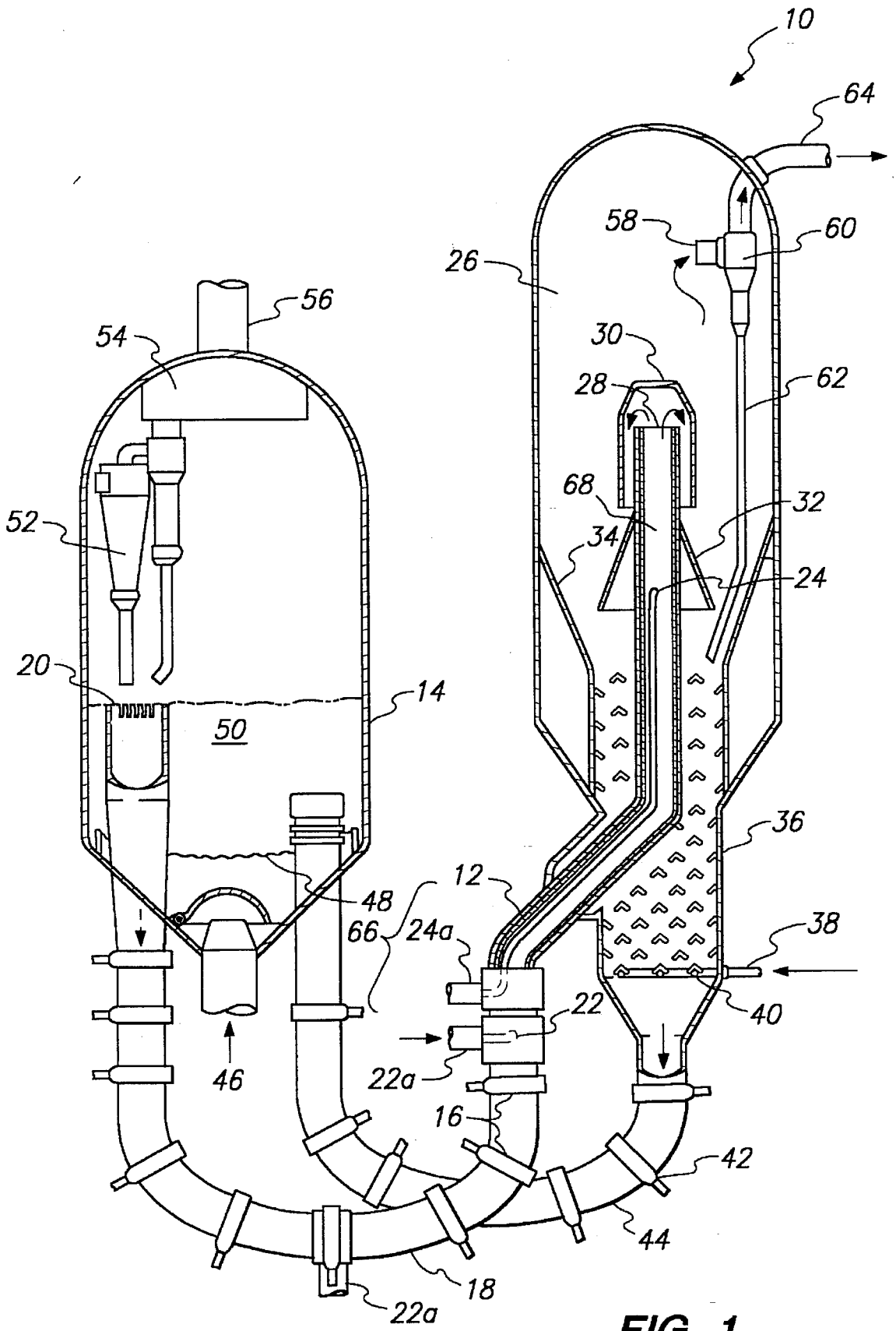
FIG. 1 is a vertical elevation view, partially in cross-section, of one embodiment of a preferred form of the invention in a fluid catalytic cracking (FCC) system. A feed pipe enters the riser upstream of the location of the separator and extends into the end section of the riser surrounded by the separator vessel.

Referring now to the drawings, and in particular to FIG. 1, there is illustrated a fluidized catalytic cracking (FCC) unit to which the present invention is particularly applicable. The FCC unit, indicated generally by the number 10, comprises a riser reactor pipe 12 to which heated catalyst is supplied by regenerator 14. Catalyst is fluidized by gas, preferably steam or hydrocarbon vapor, supplied by a series of nozzle rings 16 along U-tube 18. The fluidizing gas transports catalyst particles supplied by gravity from overflow intake 20 and conveys them to riser 12. Hydrocarbon feed streams, such as those supplied through feed nozzles 22 and 24 and feed lines **22*a* and 24*a* enter riser reactor 12 for contact with the heated, fluidized catalyst. The rapid reaction of mixing heated (generally regenerated) catalyst and hydrocarbon feed generates voluminous quantities of vapor by vaporization and cracking of the hydrocarbons which carries the mixture upwardly in riser reactor 12 and discharges it into separator vessel 26 through discharge orifice 28**.

In the embodiment of FIG. 1, this discharge is generally upward but is deflected downwardly by a discharge shroud 30 surrounding the upper part of riser reactor 12 so that flow of the resultant mixture of catalyst and hydrocarbonaceous material, and primarily the catalyst, is downwardly into separator vessel 26. Discharge from shroud 30 is deflected outwardly by a baffle, such as deflector cone 32, toward sidewall 34 of vessel 26 so that the inertia of the catalyst, along with gravity effects on the catalyst, assists in separation of residual hydrocarbon vapor from the catalyst.

Spent catalyst is then returned to regenerator 14 through stripper means 36, formed either independently or as the lower part of vessel 26.

Hydrocarbons are further removed from the spent catalyst in stripper 36 by introduction of steam, such as by line 38 feeding nozzles 40 at the lower end of stripper 36. Catalyst returns to regenerator 14 by introduction of steam through a series of nozzle rings 42 along return U-tube 44 for transport of such spent catalyst back to regenerator 14. Spent catalyst is then regenerated by addition of oxygen, as by line 46, to burn residual coke, primarily carbon, from the catalyst particles supported on grid 48. This supplies heat to the catalyst circulating in the system which returns from bed 50 through overflow intake 20. Offgas from the burned coke is vented from regenerator 14 through cyclone 52, plenum 54 and flue pipe 56.

The cracked hydrocarbon vapors in separator vessel 26, along with entrained catalyst fines, pass through pipe 58, the inlet for cyclone 60. Cyclone 60 then separates catalyst fines from the vapor and returns the catalyst fines by dip leg 62 to stripper 36. Vapor from the cyclone 60 exits through conduit 64 to a conventional distillation system (not shown).

In the split feed arrangement of FIG. 1, conventional hydrocarbon feed nozzle 22 is located in the portion 66 of riser reactor 12 which is "external", i.e., unenclosed by the separator vessel 26. Feed nozzle 24, however, located within the enclosed or "internal" portion 68 of the riser reactor 12, provides for injection of hydrocarbon feed into the internal portion. This is accomplished without passage of feed line **24*a* through sidewall 34** of the separator vessel.

In a preferred arrangement, the nozzle 24 is located in a section of the riser reactor about 2 feet above the lower feed nozzle 22 and about 12 inches from the discharge orifice 28 and has a diameter of from about ½ to about 4 inches. Feed line **24*a*** may be of conventional construction and have an internal diameter of from about ½ to about 4 inches.

Generally, the feed nozzle 24 is positioned at a point within the 60% of the length of the internal portion of the riser reaction adjacent the discharge orifice 28. Depending on the feed composition and other factors, the feed nozzle 24 may be positioned within the last 40% of the length of the internal portion or within the last 10% of the length of the internal portion. The compositions of the various hydrocarbon feed streams can be the same or different and have different boiling point ranges. In addition, the feed rates in the hydrocarbon feed streams can vary, for example, the amount of hydrocarbon feed passing through feed nozzle 24 can comprise from 1% to 99% by weight of the total hydrocarbon feed. Depending on feed conditions, the amount of the feed to nozzle 24 can comprise from 1% to 60% of the total hydrocarbon feed.

The hydrocarbon feed entering either or both of the internal and external portions of the riser reactor can, moreover, be comprised in whole or in part of recycled hydrocarbon components from the hydrocarbon recovery means (e.g., distillation system).

Because of the rapid generation of large amounts of gasses during the cracking process, and the attendant vibratory effects within the riser reactor pipe, feed line **24*a* is securely fastened to the internal wall of the reactor pipe. An example of a suitable fastening means is illustrated in FIGS. 2 and 3**.

Figure 2:
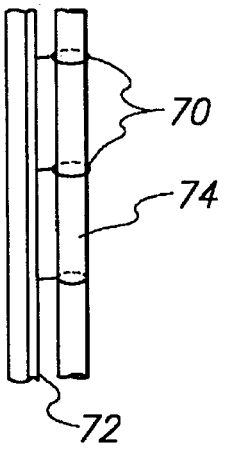
FIG. 2 is a partial cross-section of the fluid catalytic cracking system of FIG. 1, illustrating the feed pipe in the riser and the pipe supports securing the feed pipe to the riser.
Figure 3:
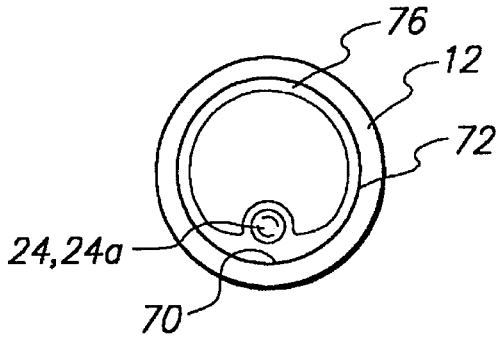
FIG. 3 is a cross-section of the feed pipe and the riser reactor with a coating of an abrasion resistant compound over both.

As shown in FIG. 2, a plurality of spaced ring supports 70 surround the feed line 24*a* and are attached to the inner wall 72 of the riser reactor pipe 12. Generally, the feed line 24*a* is spaced from the inner wall 72 with from about 0 to about 1 inches between the inner wall 72 and the outer surface 74 of the feed line 24*a*. As shown in FIG. 3, the inner wall 72 of the riser reactor pipe 12 and the outer surface 74 of the feed line 24*a* are preferably coated with an abrasion resistant compound 76 such as a ceramic.

The following example illustrates the retrofitting of an existing FCC unit with an internal feed.

EXAMPLE

Figure 4:
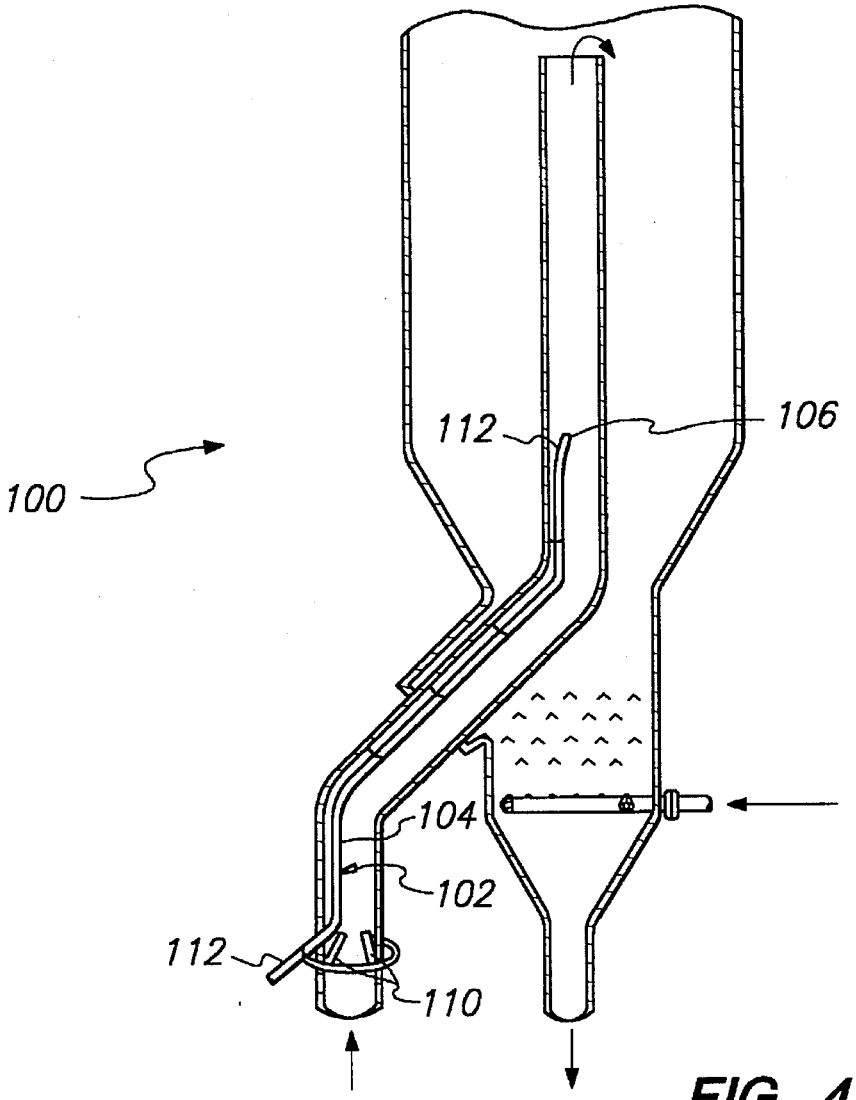
FIG. 4 is a vertical elevation view, partially in cross-section, of an existing FCC unit which has been retrofitted with a feed pipe extending into the separator vessel.

An existing FCC unit 100 as shown in FIG. 4 is retrofitted to provide an upper injector 102 which includes a feed line 104 and nozzle 106. This allows a second feed stream comprised of easily cracked material to be processed with only 30% of the contact time of the normal feed. In order to avoid the expense and down time required for construction of a typical injector entering through a separator wall 108, one of the six conventional injectors 110 is modified such that the existing feed header is bypassed and a new header for the alternate feed stream is installed. The internal section of the injector is extended up 70% of the riser reactor and terminates in a conventional dispersion nozzle 106. The entire modification is accomplished with a minimum of welding and no violation of existing pressure-rated or structural walls. The extended section of the injector is supported with rings 112 welded to the riser reactor internal wall and coated with abrasion resistance ceramic supported by wire mesh (not shown).

In addition to the single extended feed line 104 and nozzle 106 shown in FIG. 4, the invention contemplates the installation of a plurality of extended feed lines each terminating in a nozzle at the same or different locations within the internal portion of the riser reactor. It is further contemplated that one or more extended feed lines 104 have a plurality of nozzles, the feed line or feed lines 104 acting as headers for distributing feed to the multiple nozzles.

The principles, preferred embodiments and modes of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the following claims be embraced thereby.

What is claimed is:

1. In an apparatus for fluidized catalytic cracking of hydrocarbons, including a riser reactor and means for circulating a heated mixture of catalyst particles and hydrocarbonaceous material for catalytic reaction of said material in said riser reactor, means for discharging of an output of said riser reactor into a large diameter separator vessel, said riser reactor including an internal portion disposed within said separator vessel and extending from a lower portion of said vessel to an upper portion thereof and an external portion not enclosed by said separator vessel and generally below said internal portion of said riser reactor, means for separating hydrocarbon vapors from spent catalyst in said separator vessel, stripping means for recovering residual hydrocarbon vapors from said spent catalyst passing from said separator vessel to a catalyst regenerator for recycling of regenerated catalyst to said riser reactor and means within said separator vessel for recovering cracked hydrocarbon vapors for transfer to hydrocarbon recovery means for recovery of hydrocarbon components therein, the improvement which comprises:

at least one hydrocarbon feed means positioned within said internal portion of said riser reactor and said at least one hydrocarbon feed means including a feed line entering said riser reactor at said external portion and extending in said riser reactor to a location in said internal portion above the external portion of the riser reactor, and a nozzle connected to said feed line at said location above the external portion of the riser reactor for injecting the hydrocarbon feed into the riser reactor, and at least one hydrocarbon feed means positioned in the external portion of said riser for injecting feed into said riser reactor below the internal portion of said riser.

2. An apparatus as claimed in claim 1, wherein said nozzle is located from about 12 inches below the riser reactor discharge to about 12 inches above the end of the external section of the riser reactor.

3. An apparatus as claimed in claim 1, wherein said feed pipe is spaced from about 0 to about 2 inches from an inner wall of said riser reactor.

4. An apparatus as claimed in claim 3, wherein the inner wall of said riser reactor and the outer surface of said feed line are coated with an abrasion resistant compound.

5. In an apparatus for fluidized catalytic cracking of hydrocarbons including a riser reactor and means for circulating a heated mixture of catalyst particles and hydrocarbonaceous material for catalytic reaction of said material in said riser reactor, means for feeding hydrocarbons to said riser reactor, means for discharging an output of said riser reactor into a large diameter separator vessel, said riser reactor including an internal portion disposed within said separator vessel and extending from a lower portion of said vessel to an upper portion thereof and an external portion not enclosed by said separator vessel, means for separating reacted hydrocarbon vapors from spent catalyst in said separator vessel, stripping means for recovering residual hydrocarbon vapors from said spent catalyst passing from said separator vessel to a catalyst regenerator for recycling of regenerated catalyst to said riser reactor and means within said separator vessel for recovering cracked hydrocarbon vapors for transfer to hydrocarbon recovery means for recovery of hydrocarbon components therefrom, the improvement wherein said means for feeding hydrocarbons to said riser reactor comprises:

a first hydrocarbon feed means for injecting a first feed into said internal portion, said first feed means entering said riser reactor at said external portion and extending into said internal portion, and a second hydrocarbon feed means for injecting a second feed into said external portion.

6. The apparatus of claim 5, including means for securing said first feed line adjacent to an inner wall of the riser reactor.

7. The apparatus of claim 6, including an abrasion resistant coating placed over said first feed line and said inner wall of the riser reactor.

8. The apparatus of claim 5, wherein said first and second hydrocarbon feed means each include a nozzle.

9. The apparatus of claim 8, wherein the nozzle of said first hydrocarbon feed means is positioned within the last 10% of the length of the internal portion of the riser reactor adjacent the discharging means.

10. The apparatus of claim 8, wherein the nozzle of said first hydrocarbon feed means is positioned within the last 40% of the length of the internal portion of the riser reactor adjacent the discharging means.

11. The apparatus of claim 8, within the nozzle of said first hydrocarbon feed means is positioned wherein the last 60% of the length of the internal portion of the riser reactor adjacent the discharging means.

* * * * *